United States Patent [19]

Weems et al.

[11] Patent Number: 4,756,770

[45] Date of Patent: Jul. 12, 1988

[54] WATER SLAP STEAM GENERATOR CLEANING METHOD

[75] Inventors: Sterling J. Weems, Chevy Chase, Md.; Albert C. Buford, III, Cabot, Ark.

[73] Assignee: Arkansas Power and Light Company, Little Rock, Ark.

[21] Appl. No.: 828,335

[22] Filed: Feb. 11, 1986

[51] Int. Cl.[4] ..... B08B 3/12; B08B 5/00

[52] U.S. Cl. ..... 134/37; 134/1; 134/22.18; 134/22.12; 122/383; 122/388; 122/398; 165/95; 376/316

[58] Field of Search ..... 134/22.18, 22.12, 1, 134/37; 122/383, 388, 398; 165/95; 376/316

[56] References Cited

U.S. PATENT DOCUMENTS

| | | | |
|---|---|---|---|
| 3,888,212 | 6/1975 | Wolowodiuk | 122/22 |
| 3,895,465 | 7/1975 | Korn et al. | 376/310 |
| 3,900,010 | 8/1975 | Stiteler et al. | 122/379 |
| 3,942,481 | 3/1976 | Bennett | 122/32 |
| 4,068,627 | 1/1978 | Giesecke | 122/34 |
| 4,158,387 | 6/1979 | McDonald | 165/71 |
| 4,261,300 | 1/1981 | Cross et al. | 122/388 |
| 4,579,087 | 4/1986 | Stol et al. | 122/32 |
| 4,579,088 | 4/1986 | Kim et al. | 122/34 |
| 4,645,542 | 2/1987 | Scharton et al. | 134/1 |
| 4,655,846 | 4/1987 | Scharton et al. | 134/1 |

*Primary Examiner*—Asok Pal

*Attorney, Agent, or Firm*—Stephen D. Carver

[57] ABSTRACT

A non-corrosive, non chemical cleaning process for tube bundle heat exchangers develops and physically transmits kinetic energy in the form of a vigorous, high volume "water slap" to dislodge internally accumulated contaminants. A plurality of injectors periodically inject discrete quantities of pressurized inert nitrogen into the heat exchanger downcomer annulus, near the steam generator bottom, and in response to the expanding gas bubble the water column established in the tube bundle is accelerated upwardly. A rapid displacement of a body of water causes the surface of the water to slap debris from components in its path. The water column level is established slightly below the bottom of a tube support structure, and the rapid rise of the water surface impacts the bottom of the structure and is forced through the water flow passageways where the fluid flow acceleration pressures dislodge the accumulated debris. The water level is established slightly below the estimated position of the target tube support structure to be cleaned and, as timed gas injection proceeds at intervals adequately spaced to allow the gas to clear the water and the water surface to come to rest below the target structure before injection is resumed. Concurrently, one may simultaneously circulate and filter the water in order to remove loosened debris after slapping of the last internal structure is completed, or employ another suitable contaminant removal technique.

16 Claims, 5 Drawing Sheets

WATER SLAP STEAM GENERATOR CLEANING METHOD

BACKGROUND OF THE INVENTION

The present invention relates generally to the maintenance of high pressure steam generating heat exchangers suitable for use in conjunction with the generation of electricity at nuclear powered facilities. More particularly, the present invention is related to a non-chemical, non-corrosive cleaning process for tube bundle heat exchangers, which must be cleaned at periodic intervals for the removal of accumulated sludge and debris.

The prior art reflects a variety of steam generation systems for use at nuclear powered electrical generation plants. All modern nuclear steam generators generally exchange heat between a reactor-heated primary fluid and a secondary fluid such as water which flows through the steam generator in isolated, heat exchange relation with respect to the primary fluid. The various types of heat exchangers used in nuclear power generation systems, as will be recognized by those skilled in the art, may broadly be characterized as being of the recirculating type or the "once through" (OTSG) type. In either case a primary and secondary coolant are disposed in heat exchange relationship, and necessary operating temperatures and desired energy levels of operative steam are facilitated via appropriate circulation through the apparatus. The present invention is adapted to be successfully employed in conjunction with cleaning of either once through steam generator heat exchangers (OTSG's) or recirculating heat exchangers.

U.S. Pat. No. 4,158,387 issued to the Babcock and Wilcox company on June 19, 1979, discloses a once through steam generator (OTSG) for use at nuclear power plants. The device comprises an upright pressure vessel having disposed therewithin a plurality of heat exchange tubes which extend longitudinally through the interior of the apparatus and which are braced and supported at vertically spaced apart intervals by a plurality of suitable tube bundle support plates. The heat exchange tubes are confined within a generally cylindrical shroud concentrically disposed within the generator, and the space between the shroud and the outer casing is divided into an upper steam annulus and a lower downcomer annulus. A first heat exchange passageway to the system is defined through a primary coolant inlet nozzle which thermally communicates with a plurality of elongated, longitudinally extending heat exchange tubes, and terminates in a suitable outlet channel for transmission of the primary coolant back to the reactor.

Concurrently, incoming water to be vaporized is transmitted inwardly of the downcomer annulus to near the vessel bottom, through various windows, and upwardly through the tube bundle shroud between the spaces defined between adjacent tubes and the tube bundle support plates. Significant boiling occurs, and steam generated thereby exits the generator through the steam annulus. A similar heat exchanger is seen in U.S. Pat. No. 4,068,627 issued Jan. 17, 1978.

However, as will be well recognized by those skilled in the art, the use of such generators results in the accumulation of certain undesirable solid contaminants which are deposited within the heat exchange apparatus, primarily upon the tube sheets, tubes and their tube support structures. Entrained and dissolved solids, most of which are introduced into steam generators by entering feed water, tend to concentrate within the boiler water rather than exiting with the generated steam. A significant quantity of entrained and dissolved solids will be distributed throughout the boiler water. Their accumulation upon the tubes and the various tube bundle support plates will interfere with secondary coolant transmission and cause the reduction of heat transfer efficiency. Corrective maintenance is thus periodically mandated.

Within the once through steam generator (OTSG) particularly vexatious sludge accumulates upon the entrance and flowholes of the tube bundle support plates. This deleteriously increases flow resistance for the secondary fluid, thereby increasing the water level in the downcomer due to the flow resistance, eventually requiring a reduction in plant operating capacity to prevent flooding of the steam aspiration port and concomitant generator instability. It has also been suggested that particles of sludge broken loose from internal surfaces (for example tube scale) by normal operating transients may be carried upwardly by the steam flow such that they can block or become wedged in the flow holes of upper tube support plates and cause an increase in flow resistance. In a recirculating heat exchanger contaminant buildup can cause tube plate cracking, tube denting or other undesirable conditions.

Contaminant removal is thus mandatory for efficient steam generator operation, and a variety of solutions have been proposed previously for removing unwanted contaminants. U.S. Pat. No. 4,158,387 discloses relevant background information which is extremely relevant to the present invention. It provides a blowdown apparatus suitable for use with OTSG heat exchangers whereby sludge accumulation and similarly unwanted debris may be disposed of as a means of cleaning. A related blowdown system for sludge cleaning is suggested through the use of reverse circulation and the injection of nitrogen gas by the apparatus of U.S. Pat. No. 4,261,300.

U.S. Pat. No. 2,972,986 discloses a system wherein the concentration of dissolved solids within a steam generator contemplates the discharge or blowdown of unwanted water. A steam generator with vertical tube sheets is disclosed in U.S. Pat. No. 4,068,627, wherein it is provided for the collection of the unwanted crud or solid deposits immediately above the lowest tube sheet. A liquid metal steam generator is disclosed in U.S. Pat. No. 3,888,212. Similarly, a steam generator having a U-shaped tube bundle is seen in U.S. Pat. No. 3,942,481.

A nuclear steam generator which has a blowdown pump arranged to pump water from a blowdown line is disclosed in U.S. Pat. No. 4,261,300. U.S. Pat. No. 3,895,465 issued July 22, 1975 contemplates the injection of particles of Boron Trioxide propelled through suitable jets with compressed gas to cause appropriate abrasion whereby contaminated surfaces within the nuclear heat exchanger may be appropriately cleaned.

It is well known to provide internal cleaning through various chemical additive systems, wherein the injection of certain corrosive chemicals within the heat exchanger chemically dislodge unwanted solids. Typical of this process is the system described in U.S. Pat. No. 3,900,010 issued Aug. 19, 1975.

However, chemical cleaning systems of the type known to us inherently give rise to a variety of problems. Conventional chemical cleaning systems are rather slow and tedious to employ. Also, the injection of suitable chemical additives of appropriate strength to dissolve, dilute or dislodge accumulated sludge and debris often leads to unwanted deleterious damage within the apparatus being cleaned. Moreover, disposal of the used chemicals is difficult and costly.

Accordingly, the prior art has suggested the use of various agitation systems including gas injection for cleaning the interior of heat exchangers. Gas injection has been employed previously in conjunction with U.S. Pat. No. 4,261,300 issued Apr. 14, 1981 for the purpose of agitating the water during wet lay up to improve distribution of recirculated water in an attempt to more conveniently and economically extract unwanted solids. This may be used in conjunction with blowdown, recirculation and filtration.

Recently it has been proposed to clean tube bundle heat generators (OTSG's) by periodically subjecting the tube bundle shroud interior to blasts of high pressure gas. Such systems periodically inject nitrogen through suitable radially spaced apart pulsers to periodically release high pressure bubbles of nitrogen. The sudden release of the high pressure gas produces a pressure pulse such that explosive noncontinuous spherical shock waves agitate the deposited sludge to provide a degree of cleaning. It is believed that ANCO Engineers Inc. of Culver City, Calif. have previously proposed gas injection involving sonic cleaning of submerged parts within the interior of OTSG's in U.S. patent applications Ser. Nos. 06/742,134 (a continuation of prior patent application Ser. No. 06/486,352); 06/686,242 and 06/604,048.

In our opinion, however, and based upon our own test experience and data, mere sonic shockwave agitation insufficiently cleans the critical clogged holes in the tube bundle support plates of conventional OTSG's, and the shock waves must be limited in intensity to prevent deleterious effects upon critical steam generator components.

For vigorously cleaning the interior of tube bundle heat exchangers, we have found it desirable to utilize the energy of controlled high pressure gas injection at discrete intervals to periodically lift the pool of water such that the rising surface of the water periodically slaps the surface to be cleaned. The phenomena is referred to herein by the term "water slap." The process intentionally reduces the acoustic energy content of the water column by slowing the gas release rate to eliminate potentially damaging effects.

Specifically, the water surface impact upon the tube support plate produces very high localized pressures which are sufficient to break up and dislodge deposits in the path of the advancing water surface. These pressures and the resultant high velocity flows of the ascending water level created by the introduction of inert gas into the bottom of the heat exchanger are thereby concentrated on the desired vessel internal.

SUMMARY OF THE INVENTION

The present invention comprises a method for cleaning the internal parts of tube bundle heat exchangers. The method contemplates the controlled injection of inert gas, preferably nitrogen, to produce a rapid ascension of the water level within the tube bundle heat exchanger causing the surface of the water to impact certain heat exchanger components located just above the at-rest water level.

The resultant localized hydrodynamic pressures are of sufficient magnitude to dislodge accumulated debris, contaminants and the like encrusted upon internal heat exchanger parts. The cleaning method of the present invention is ideally adapted for use with once through steam generators (OTSG's) such as the Babcock and Wilcox model 177FA, or other Babcock and Wilcox steam generators such as that shown and described in U.S. Pat. No. 4,158,387. Of course it will be appreciated that the instant method may be successfully employed with a wide variety of other steam generator and heat exchange apparatus, such as continuous recirculating steam generators and the like.

A typical tube bundle heat exchanger system experiences the build up of offensive debris upon the elongated internal heat exchange tubes, and upon and within the water flow passages of the spaced apart tube bundle support structures disposed interiorly of the tube bundle shroud. For efficient heat exchange to occur, relatively unobstructed water passage of the secondary working fluid through the tube handle heat exchanger is mandatory. Contaminants and debris in an O.T.S.G. tend to impede secondary water passage and hence create a rise in the water level within the generator downcomer which requires a reduction in the incoming secondary flow rate to prevent flooding the aspiration port and thus limits the plant operating capacity. The heat exchange system internals must be cleaned periodically to allow the ability to maintain maximum generating capacity. In a recirculating heat exchanger the build-up of crud in the tube support structure holes can result in cracking of the tube support structure and/or denting of the tubes.

In the best mode of the present invention a first step is to vent the steam generator to allow for a constant ambient pressure during application of the process which will loosen the contaminants within the tube bundle heat exchanger by utilizing the force of "water slap." Timed injections of discrete quantities of high pressure inert gas (preferably nitrogen) are injected into the lower portion of the tube bundle heat exchanger producing a rapid rise of the water level within the tube bundle causing the water surface to forcibly slap the components located directly above the at-rest water column level.

Such "water slap" phenomena occurs in a closed environment when the bottom of the water column is subjected to the introduction of a gas which causes rapid displacement of the entire body of water including its surface. Energy in the form of a body of water in motion is utilized to directly physically contact (i.e. slap) portions of the heat exchange tubes and, importantly, the supportive tube support plates disposed within the shroud.

When the at-rest water level is located just below a tube support plate, the plate receives direct physical contact with the rising water surface which causes the water to "slap" against the plate and force its way through the contaminated holes of the tube support plate, forcing the contaminants out of the holes in the process. Some of the flow holes in the tube support plates may be blocked by accumulated debris which clogs the critical flow holes. The high velocity water flow up through the holes in a tube support plate resulting from the injection of gas dislodges and breaks up this "crud," clearing the steam passageways and allowing the crud to fall through the holes for subsequent removal from the vessel.

Water level may be monitored in operation through suitable manometer apparatus coupled across suitable tube bundle heat exchanger vents. However, since the exact position of the tube support plates cannot be readily determined with any degree of certainty, and since the exact position of the water surface within the tube bundle heat exchanger cannot be conclusively determined, a first reference water level can be initially established within the tube bundle heat exchanger by pumping water to a level estimated to be slightly above the level of the first of the tube bundle support plates to be cleaned. Usually the process starts by cleaning the second-to-lowest tube bundle support plate, because the first tube bundle support plate is generally not significantly fouled.

The water level is approximately adjusted to a level merely above the estimated level of the first tube support plate to be cleaned. A plurality of injectors are employed to forcibly inject discrete quantities of high pressure nitrogen gas at timed intervals, at a pressure of between generally 25–1500 psi above ambient pressure into the bottom of the generator. Displacement of the water results in the creation of a powerful acceleration of the water column contained in the tube bundle until equilibrium of ambient water pressure and nitrogen bubble pressure is attained. After sufficient time is allowed for the bubble to rise and exit from the water (about 7-22 seconds depending upon application) and the water level is returned to its at-rest position, the injectors are repetitively triggered again, while water is slowly drained from the generator. This insures that the water surface will pass through the optimum level at which the level swell velocity and resultant impact forces will break and remove deposits from the holes of the tube support plates.

This cleaning period may occur over one to five hours per target internal. In one mode of the invention, the shroud water is continuously recirculated and filtered to capture at least a portion of the solids and impurities dislodged as a result of water slap. In the process the pulser or injector configuration, gas flow rates, volumes and pressures are selected so as to effectuate a minimum water swell velocity required to remove the sludge while upper load limits are restricted to insure against physical damage to the steam generator.

Water swell velocity is normally limited to values of between approximately 2.0 feet per second and 10.0 feet per second to provide sufficient water slap effect while minimizing component stresses.

The next higher tube support plate is then cleaned by raising the water column to a level estimated to be approximately slightly above the level of the next target tube support plate, and the process is repeated similarly until each of the tube support plates to be cleaned has been adequately treated.

Experience has revealed that in the OTSG generally only the first ten tube support plates need to be cleaned in this fashion, since they are operationally disposed within the region of nucleate boiling or below, where most crud accumulation occurs. However, the process can be used to clean as many of the tube support structures as needed.

The next major step of the cleaning process contemplated by the present invention is to capture and remove the debris and sludge dislodged into the water column which can be accomplished by a variety of means, including recirculation and filtration during water-slap, high volume recirculation after water slap, and/or "sludge lancing" methods.

Thus a primary object of the present invention is to provide a non-chemical system for cleaning steam generators.

A similar object of the present invention is to provide a gas injection system that discharges discrete quantities of high pressure inert gas for cleaning steam generators such as OTSG's utilizing a water slap phenomena.

A related object of the present invention is to provide a cleaning system for loosening contaminants, sludge, and debris, which employs the physical energy of a water slap phenomena.

Thus a related object of the present invention is to employ cleaning energy efficiently by physically contacting and "slapping" tube support plates rather than by merely flushing them.

A still further object of the present invention is to time gas injection sequences appropriately so as to allow the gas bubbles to clear the water and to allow the water surface to come to rest below the target vessel component between pulses, so that energy will be expended by physically slapping the target rather than wasting the energy compressing gas bubbles.

A basic object of the present invention is to provide a water slap cleaning process for cleaning the interiors of steam generators without the use of corrosive chemicals.

A still further object of the present invention is to provide a debris removal system suitable for use with such a method, to remove the debris loosened to prevent it from becoming redeposited in the critical secondary fluid flow regions.

A further object of the present invention is to provide a water slap level swell cleaning system which maximizes the effects of physical slapping energy rather than by employing the agitation produced by sonic shock waves.

Similarly it is an object of the present invention to avoid the sonic shock gas injection systems of the prior art, and to maximize the water slap impact loads via the gas injection systems hereinafter described.

A further object of the present invention is to produce rapid acceleration of the water column within a pressure vessel causing the rising surface of strike pressure vessel components in its path.

A further object of the present invention is to limit the rate of acceleration of the water so that the dynamic response of the various OTSG intenals will be minimized (i.e. loads will be more like statically applied loads instead of like suddenly applied loads).

Another object of the present invention is to avoid any excessive hydrodynamic loads which could physically damage steam generator internals.

Another fundamental object of the present invention is to produce a sudden rise in the water level which causes the water to forcefully squirt up through the flow holes in the tube support plate thereby removing blockages of crud and debris from these flow holes, breaking it up and allowing it to be removed from the pressure vessel.

A further object of the present invention is to maximize water level accelerating while minimizing sonic shock.

A basic object is to provide a cleaning system suitable for recirculating and OTSG generators.

These and other objects and advantages of the present invention, along with features of novelty appurtenant thereto, will appear to become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 12:
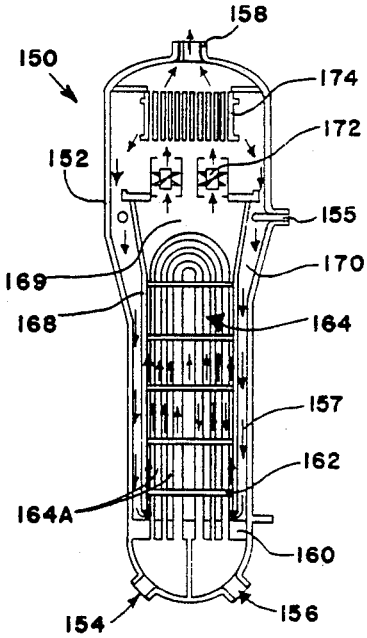

With initial reference now directed to the appended drawings, a conventional once through steam generator (hereinafter referred to as "OTSG") has been generally designated by the reference numeral 10. The illustrated OTSG is similar to the Babcock and Wilcox Model 177 FA, as described in a report BAW 10146, and is also similar to the OTSG disclosed in U.S. Pat. No. 4,158,387 and the like, except that it does not include a blowdown pipe for cleaning purposes. U.S. Pat. No. 4,158,387 is hereby incorporated by reference for purposes of disclosure. A conventional recirculating type heat exchanger is illustrated in FIG. 12, and will be described in detail hereinafter.

Figure 1:
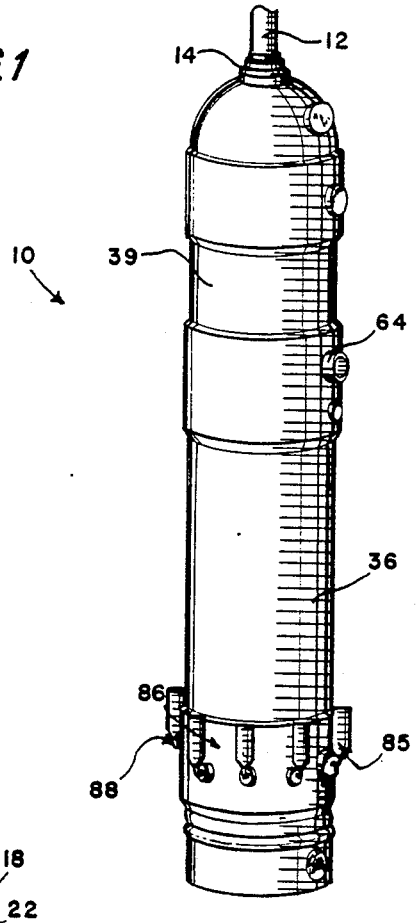
FIG. 1 is a fragmentary, pictorial view showing the exterior of a typical Babcock & Wilcox once through steam generator (OTSG) upon which the cleaning techniques of the present invention may be successfully used.
Figure 2:
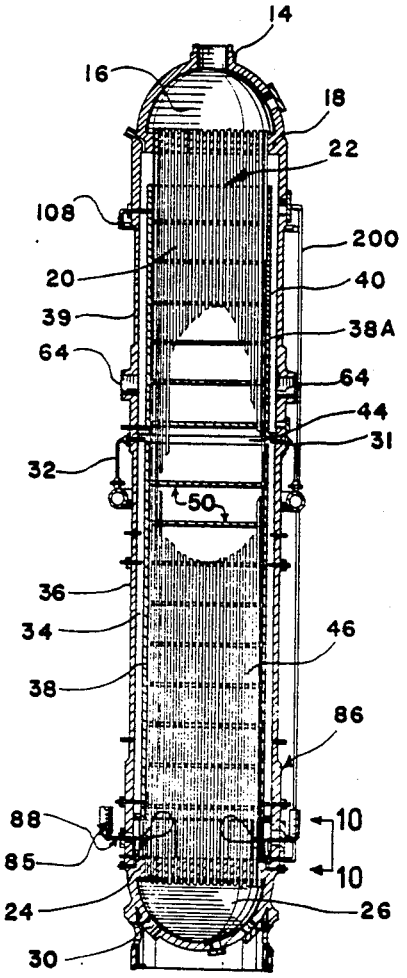
FIG. 2 is a fragmentary, longitudinal, sectional view of the OTSG of FIG. 1.
Figure 3:
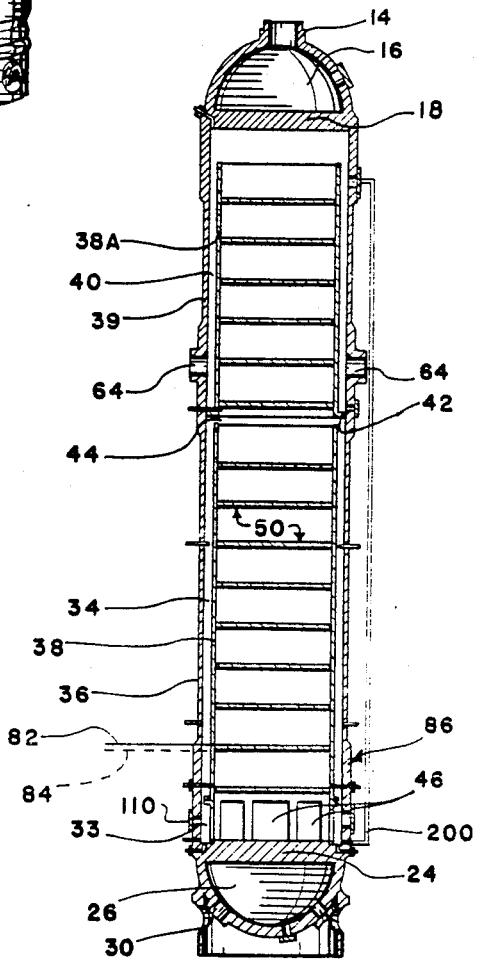
FIG. 3 is a fragmentary, longitudinal, sectional view with the tube bundle of the OTSG removed for purposes of clarity, and with various reference water cleaning levels illustrated.

Essentially the OTSG 10 comprises a giant tube bundle heat exchanger. Heated primary coolant from the nuclear reactor core enters via a suitable conduit 12 (FIG. 1) coupled to an inlet nozzle 14. This heated fluid reaches an inlet chamber 16 immediately above an upper tube sheet 18. Fluid reaching chamber 16 is transmitted through a plurality of elongated tubes 20 which collectively have been referred to as a tube bundle 22. Primary coolant is thus transmitted all the way to the bottom of the OTSG through lower tube sheet 24 into outlet chamber 26 which discharges the primary fluid through two primary outlet nozzles, such as nozzle 30 (FIGS. 2–5).

Thermal energy from the primary coolant is absorbed by incoming water inputted to the OTSG through a plurality of feed water inlets 31 and 32 which inject incoming water into the lower downcomer annulus 34 defined between the lower outer casing 36 of the OTSG vessel and the shroud 38 encompassing the lower portion of the tube bundle 22. The downcomer annulus 34 is separated from a similarly shaped steam annulus 40 formed between the upper casing portion 39 of the OTSG 10 and the upper tube bundle shroud 38A. Steam annulus 40 is separated from downcomer annulus 34 by a partition ring 42 (FIGS. 2 & 9), which is located immediately above a conventional aspiration port 44. Fluid injected into the downcomer annulus 34 enters and moves upwardly within the tube bundle shroud 38 via passageways 46 (FIGS. 2, 4, and 6), and fluid thus rises upwardly through the apparatus between the various heat exchange tubes 20 and through the flow holes 52 (FIG. 7) of the plurality of generally parallel, vertically spaced apart tube support plates 50. As used herein the expressions "plate" or "tube support plate" refer interchangeably to horizontally oriented spaced apart support plates, support crates, support strips, or similar internal structures.

With primary reference now directed to FIGS. 4 through 8, each tube support plate 50 is of rigid construction, and each includes a plurality of suitably shaped orifices 52 through which the tubes 20 penetrate. It will be noted that those unblocked portions 54 of "broached hole" orifices 52 through which secondary water is transmitted will eventually become clogged as deposits 56 tend to build up and accumulate in these regions. In operation the primary coolant transmitted through the tubes 20 at high pressures heats the secondary fluid greatly, so that high pressure steam is vented outwardly of the steam annulus 40 through a pair of suitable steam outlet nozzles 64.

During operation of the steam generator, deposits of oxides, minerals and other contaminants introduced with secondary water, can become deposited or lodged in the flow holes 54 of the tube support plate 50 causing a rise in the water level in downcomer 34 which will lead to flooding of the steam aspiration port 44 and causing unacceptable operation of the steam generator 10. To prevent this flooding requires a reduction in the feed water flow rate and therefore in unit power output. Also, accumulation of crud or deposits 56 in and upon the tube support structures 50 can cause denting and/or tube support structure damage. Through the teachings of the present invention these deposits of crud 56 may first be loosened and then removed from the tube bundle heat exchanger without the use of corrosive chemicals, agitation produced by sonic waves, or the like.

Before cleaning operations commence, the steam annulus 40 is vented to prevent undue pressure build-up.

Figure 4:
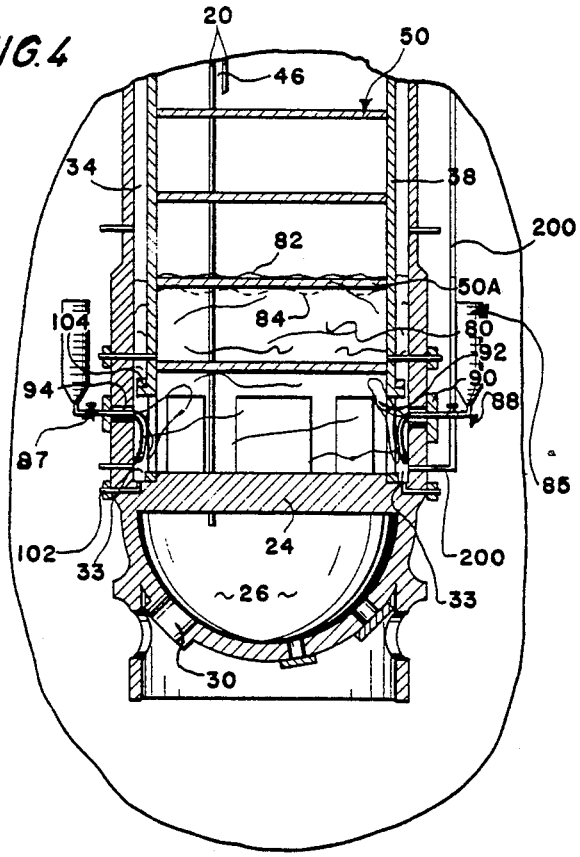
FIG. 4 is an enlarged, fragmentary, sectional view illustrating an early stage of the cleaning process, wherein the water level is set at an optimum cleaning level and the instant of inert gas injection is pictorially illustrated.
Figure 5:
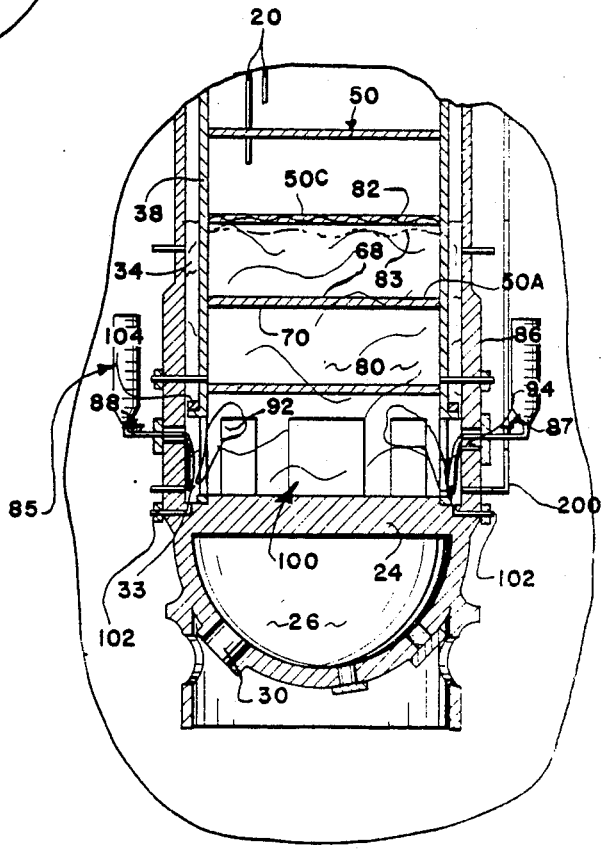
FIG. 5 is an enlarged, fragmentary, sectional view similar to FIG. 4 which illustrates a stage of the cleaning process which, in the best mode of the invention, occurs after that of FIG. 4.

The first of the OTSG tube support plates to be cleaned has been generally designated by the reference numeral 50A (FIGS. 4 and 5). The upper surface of plate 50A has been designated by the reference numeral 68, and the lower surface has been designated by the reference numeral 70. The invention contemplates the input of water 80 into the OTSG 10 to an optimum level 84 (FIG. 4) which is approximately level with the bottom of the tube support plate 50A. As the water is initially pumped in, a suitable manometer 200 may be visually inspected to determine the internal water level.

In actual practice, it is normally difficult to determine the actual water level with respect to the target tube support plate, so the optimum water level 84 may be attained by initially setting the water level 82 at a level estimated to be slightly above the target tube support plate 50A and slowly draining the water while cleaning operations continue until the water level is estimated to have been established at approximately one to three inches below optimum, thereby assuring that for a percentage of the cleaning period an ideal water level was attained. The following process description assumes cleaning is performed at the optimum water level.

To determine the operating criteria with various generator designs and contaminants, the following steps, whose significance will be readily understood by those skilled in the art, should be effectuated:

(a) Analyze the make up of the sludge, the configuration of the generator, the tenacity and distribution of the sludge on generator internals, and thereby establish the minimum water level swell velocity required to dislodge the sludge;

(b) Determine the bubble injection dynamics which will produce a swell velocity capable of removing the sludge for each cleaning level. This is accomplished by evaluating the required injector configuration and calculating the pressure, volume, and gas release time;

(c) Analyze the pressure transients produced by the release of the bubble to assure that resultant loads on the steam generator are acceptable per the requirements of Title 10, Code of Federal Regulations, Section 50.59; and, (d) Evaluate the loads produced and make necessary adjustments to injector configurations and gas pressure, volume, and gas release rates in an attempt to maximize the water level swell velocity and therefore the water-slap loads while minimizing the water flow loads due to the flow caused by the nitrogen bubble outputted by the injectors and sonic shock produced by the dynamics of bubble formation.

A plurality of radially spaced-apart nitrogen gas injectors 85 are secured about the lower collar 86 of the OTSG. Preferably each of the injectors 85 fires through an outlet line, generally designated by the reference numeral 88, secured by a suitable fitting 90 and penetrating handhole passageway 94 so as to inject gas 92 through the lower annulus 33 into the tube shroud 38 at a pressure of between approximately 25 to 1500 psi above ambient pressure. In the best mode the operating constraints for the injector apparatus are selected in accordance with steps (a)–(d) set forth above.

The injectors may also be located inside the lower annulus 33. The pressure output is regulated depending upon depth such that the lower tube support plates are cleaned at a pressure of 25 to 600 psi while the higher tube support plates may require a pressure of 500 to 1500 psi. The instant method may be practiced with a variety of high pressure gas accumulation and injecting devices, such as blast aerators or the like.

Gas (i.e. preferably nitrogen) enters the accumulator 85 via valve 91 and external pipe 93. Pipe 93 can be limited in size or an orifice can be located in this pipe if desired to limit the flow rate of nitrogen into the accumulator. The accumulator outputs via elbow 85E to the conventional electrically controlled solenoid valve 87. The accumulator is located above the injector pipe 88 and solenoid valve 87 so that any water which possibly gets into these parts will drain and be ejected during an injection cycle.

Figure 11:
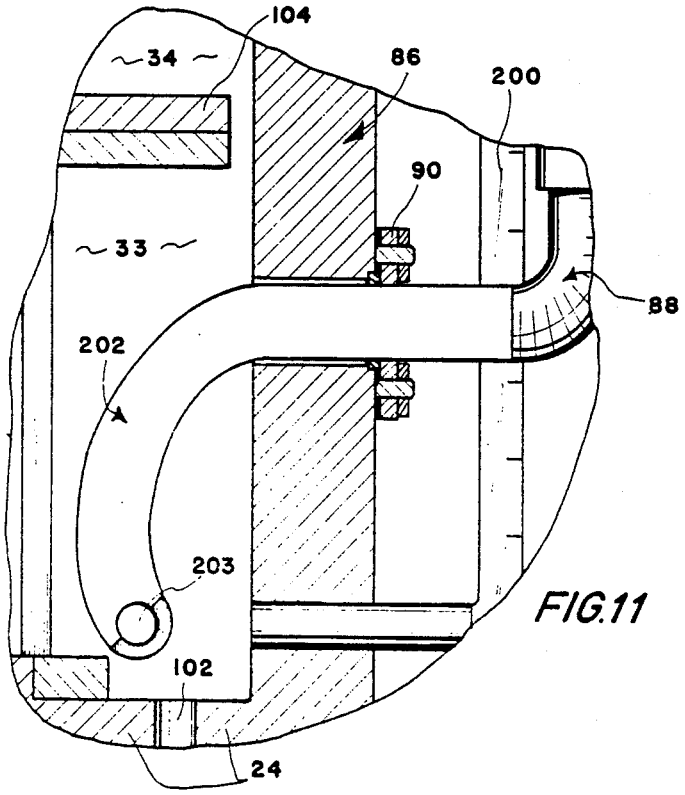
FIG. 11 is an enlarged, fragmentary sectional view of the gas injection system of FIG. 10 taken generally in the direction of arrows 11—11 of FIG. 10; and, FIG. 12 is a pictorial sectional view of a recirculating type steam generator, with portions thereof broken away or omitted for clarity.
Figure 10:
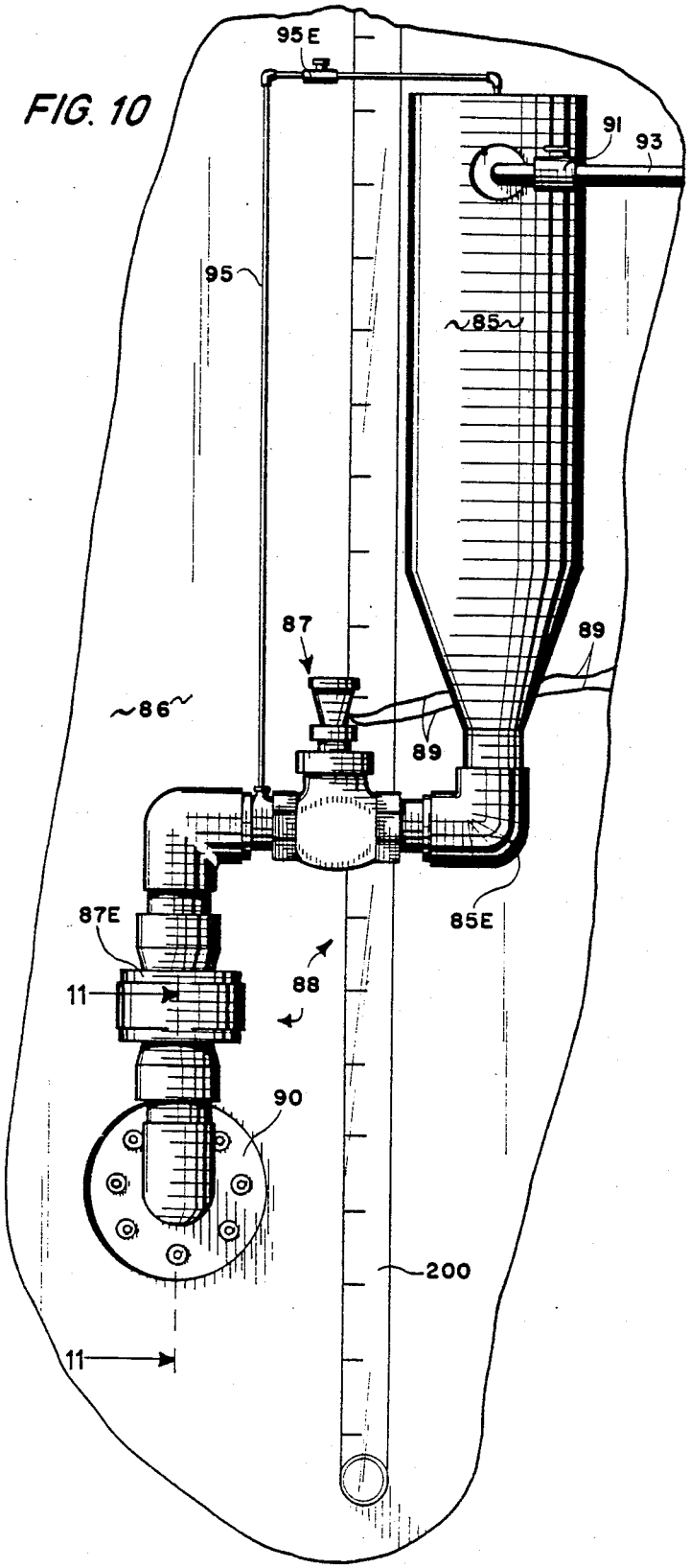
FIG. 10 is an enlarged, fragmentary pictorial view of a typical injection system, as it appears generally in the direction of arrows 10—10 in FIG. 2.

Solenoid valve 87 is cycled by an appropriate external timer via lines 89 to open and close at the intervals determined in the process development. When valve 87 is opened to discharge gas, solenoid valve 91 will be electrically closed via line 91W. When valve 87 is closed, valve 91 will be opened to charge the accumulator 85. Isolation valve 87E allows maintenance on the system without interference of steam generator water. Flange 90 couples the system to the generator shell. Injector pipe 202 (FIG. 11) serves as a conduit to direct the gas to the bottom of the steam generator, outputting gas via orifice 203 within the downcomer annulus below the lowermost tube support plate (FIG. 11).

In addition a small continuous flow of gas is introduced into the injector pipe via a small bypass flow tube 95 and a throttling valve 95E. This, is combination with the configuration of the injector pipe 202 which promotes gravity draining, insures that the injector pipe 202 will be free of water in time for the next nitrogen injection event. If the injector pipe 202 were filled with too much water, then undesirably high sonic pressure loads would be imparted to the OTSG internals.

Figure 6:
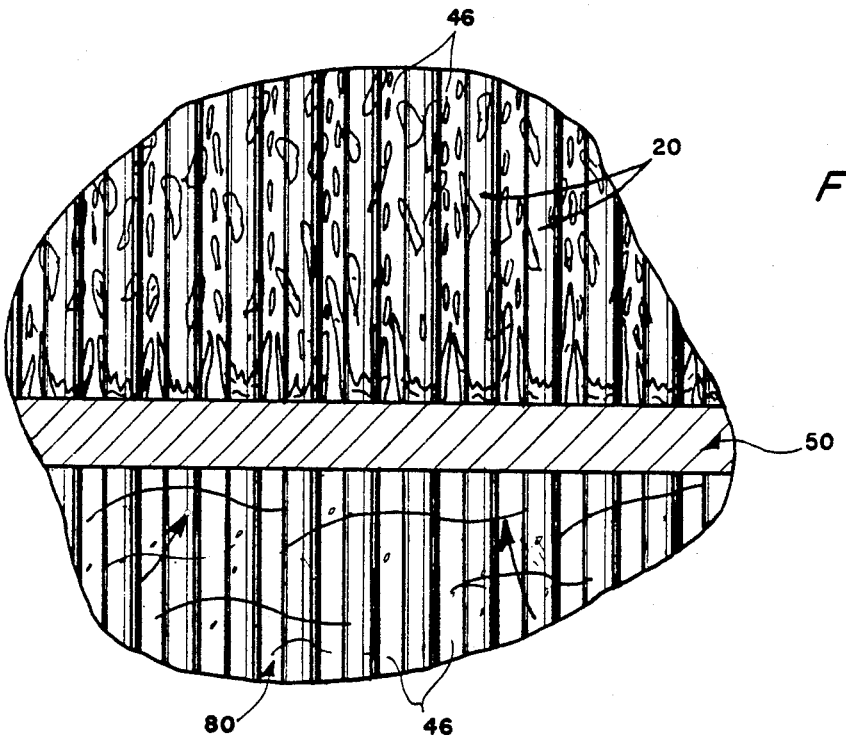
FIG. 6 is a greatly enlarged, fragmentary, sectional view illustrating the water slap phenomena at a critical tube support plate-water interface.
Figure 7:
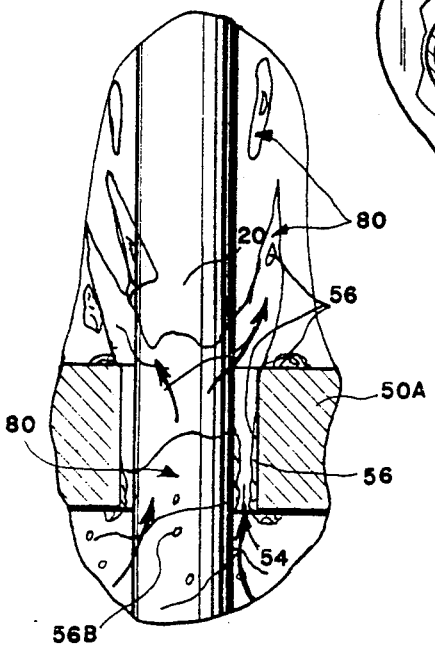
FIG. 7 is an enlarged, fragmentary, sectional view illustrating a portion of the conventional tube support plate of the type normally employed in conventional Babcock & Wilcox OTSG's, illustrating the critical tube support holes through which the heat exchange tubes pass, and which are to be cleaned through practice of the present invention.
Figure 8:
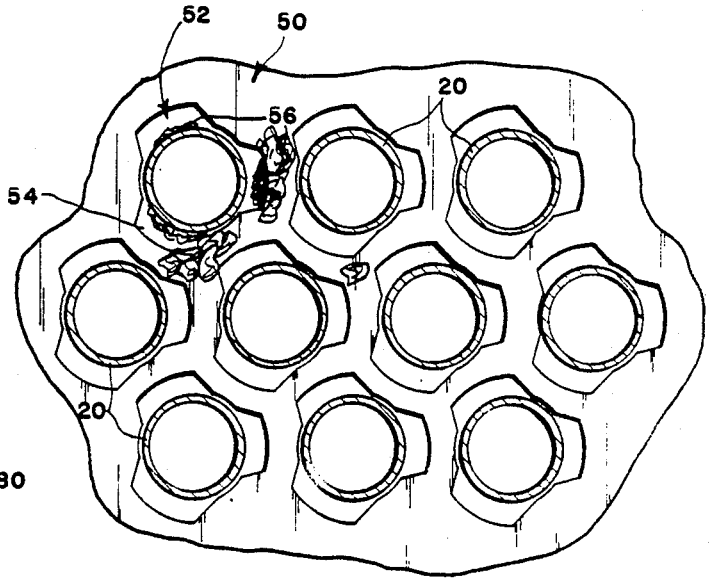
FIG. 8 is an enlarged, fragmentary sectional view illustrating the water slap phenomena of the present invention upon a particular target tube support plate.

The injected gas displaces the water within the shroud 38 causing the surface of the water to rapidly rise, creating a slap of the water surface against the target tube support plate 50A as illustrated in FIG. 6. As the displaced water moves upwardly, it forcibly contacts the deposits 56 (FIG. 8) and forces said deposits out of the tube support plate holes 52. Dislodged crud such as particles 56B (FIG. 7) may be removed as hereinafter described.

Thus a powerful water slap occurs at the water level 84, breaking up and removing the deposits 56A in the tube support plate 50A. A delay of approximately 7–22 seconds between injections is allowed for the gas bubble to pass up through the water column and for the water surface to return to the optimum cleaning range before the next injection of gas. As the water slap process continues, the water may be simultaneously recirculated and filtered to capture as much of the dislodged contaminants as possible.

After tube support plate 50A has been suitably cleaned, the water level is raised to the optimum position with respect to the next higher tube support plate 50C to be cleaned (FIG. 5). As water is drained during the process level 83 will be reached. The cleaning process will be repeated for each tube support plate to be cleaned, beginning at the lowest and proceeding upwardly until the uppermost tube support plate to be cleaned has been treated.

Dislodged debris deposited in the shroud water may be removed by subtantially continuous circulation and filtration of the shroud water while the main water slap cleaning process steps are performed. Water may be slowly pumped out of the pressure vessel 10 through a suitable drainpipe 102 (FIGS. 4 & 5) and passed through a filter. Water may then be returned through the auxiliary feedwater nozzles 108 (FIG. 2) or another appropriate opening such as a handhole 110. Water returned through the handhole 110 may be directed onto the lower tube sheet 24 to flush contaminants and debris in response to pump suction at drainpipe 102. This filtration and circulation step involves the circulation of an insufficient quantity of water to interfere with the maintenance of the water-slapping effect relative to the level of the tube support plate to be cleaned. After the uppermost tube support plate has been cleaned, timed gas injection may be continued while the steam generator water is slowly drained in order to remove any debris which was loosened from upper tube support structures and which may have become redeposited in or upon lower tube support structures during the cleaning process.

It is preferable to remove "dislodged" debris from the heat exchanger after the water slap process has loosened it, to prevent the debris from now redepositing.

After the generator is drained, the sludge removal process may be augmented by various means. A natural convective flow can be used to help move loosened debris to the lower tube sheet for removal. Filtered water is pumped into the generator 10 to a level above the aspiration port 44, and the inert gas is injected into the lower annulus 33 such that water inside the annulus is accelerated up the annulus and exits the aspiration port 44 thereby establishing a downward recirculation within the tube bundle 22. Debris which has fallen to the lower tube sheet 24 can be flushed out of the steam generator by high volume, high pressure circulation and filtration or by other sludge removal techniques.

Sludge lancing may be practiced after the draining of the pressure vessel. It involves the use of high pressure water spray to wash the loosened sludge from the lower tube sheet toward the suction of a recirculation pump which pumps the water/sludge mixture through filters and recycles the water back to the spray nozzles.

Importantly, the water slap debris loosening process will function when a reference water level is attained immediately below the plane of a target internal such as a tube support structure. If that relationship can be conclusively determined by mechanical means or visual inspection, raising or lowering the water level during the practicing of the cleaning process is unnecessary. However, if the water level relationship to the tube structure of the vessel internals cannot be conclusively determined, then initially placing the water level above the target support structure, and thereafter lowering the level while cleaning progresses, allows a means of attaching the maximum concussion water against the target structure, by passing through the optimum water level relative to the support structure to be cleaned. Starting below the tube support structure and increasing the level while practicing the cleaning process would serve the same function, but is generally more difficult to control than is draining of the water to reduce the water level.

Further, other means of evoking a rapid water level rise, such as the inflation of bladders, rapid injections of additional water and the like, would produce the water slap effects, but are more difficult to accomplish than is injection of inert gas.

With reference directed now to FIG. 12, a recirculating type steam exchanger has been generally indicated by the reference numeral 150. Exchanger 150 is of conventional recirculating design comprising an outer casing 152, a primary inlet 154, and a primary outlet 156. A feedwater inlet is indicated by the reference numeral 155, and a steam outlet is indicated by the reference numeral 158. Circulation, as will be appreciated by those skilled in the art is indicated generally by the arrows 157.

Internally of the recirculating steam exchanger 150 is a tube bundle generally indicated by the reference numeral 164, whose coils 164A are supported by vertically spaced apart tube support structures 162. Supports 162 are generally mechanically equivalent in function to the tube bundle support plates discussed earlier in conjunction with the OTSG apparatus. A lower tube sheet 160 provides lower structural support. Downcomer annulus 170 is defined between the outer casing 152 and the tube bundle shroud 168. The interior of the shroud has been generally indicated by the reference numeral 169. The primary separators are indicated by the reference numeral 172, and the secondary separators are indicated generally by the reference numeral 174. During operation of generator 150 crud and debris of course accumulates on its internals as well, necessitating periodic "water slap" cleaning as described hereinafter in Example Three.

EXAMPLE 1

Eight nitrogen injectors which were of pulser design were installed at the bottom of the downcomer annulus of the pressure vessel. These injectors were located with their main gas exhaust ports nominally 7.5–11 inches above the lower tube sheet at the centerlines of each of the seven handholes and at the manway; accordingly, the pulsers were 45 degrees apart and one pulser was located at the centerline of each of the passageways at the base of the shroud. The chamber volume for each of the pulsers was 10 to 20 cubic inches. The orifice plate 104 was opened to the 100 percent position. The water level was initially set at a level estimated to be approximately one inch above the estimated top of the second tube support plate.

The injectors were fired simultaneously at 7.5 second intervals for a period of approximately 3 hours while the water level was slowly lowered to approximately one inch below the bottom of the second tube support plate. Water was simultaneously drained from the generator, circulated through a filter and returned to the steam generator. After the second tube support plate was thus cleaned, the water level was raised to a level estimated to be approximately one inch above the upper surface of the third tube support plate and the injectors were fired simultaneously at 7.5 second intervals for a period of approximately three hours while the water was slowly drained until the level was estimated to be one inch below the bottom of the third tube support plate while water was simultaneously recirculated and filtered. The fourth, fifth, sixth, seventh, eight, and ninth tube support plates were similarly cleaned.

Figure 9:
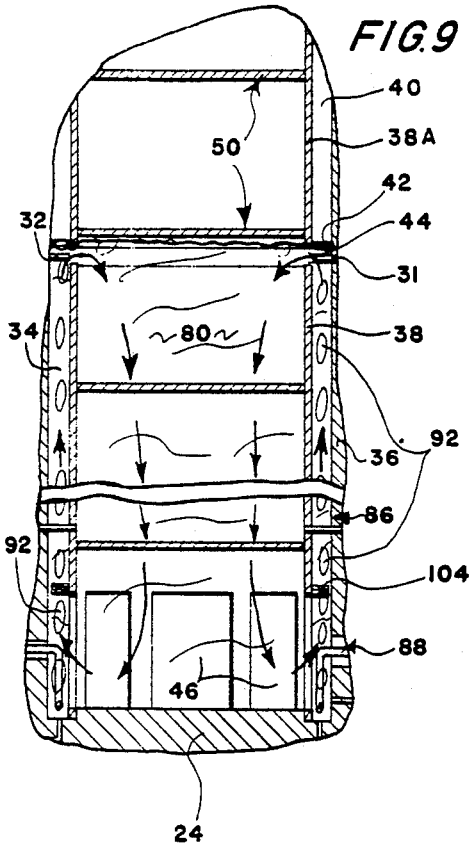
FIG. 9 is an enlarged sectional view similar to FIG. 3, depicting the natural convective flow produced by raising the water level and injecting gas in the lower downcomer annulus.

After completion of the cleaning of the uppermost tube support plate (the ninth) the water was slowly drained from the steam generator and filtered while the timed injection of gas continued in order to remove any debris which was loosened from upper tube support plates which had become redeposited in lower tube support plate holes. Finally the water level was raised above the aspiration port 44. The injectors were continually fired to produce a natural convection flow up the downcomer annulus and down within the tube bundle (as illustrated in FIG. 9) in an attempt to flush debris from between the tube support plates while simultaneous powerful recirculation and filtration of the water occurred.

EXAMPLE 2

Eight nitrogen injectors to be installed at the lower portion of the downcomer annulus are designed to provide the gas flow rates, volumes, and pressures derived from the operating criteria analysis (see Table 2 below) in order to produce the swell velocity required to remove the sludge while restricting upper load limits to prevent physical damage to the generator. These injectors are to be located with their gas exhaust ports positioned just above the lower tube sheet of an OTSG at the centerlines of each of the seven handholes and at the manway; accordingly, the injectors are to be spaced forty-five degrees apart, and one injector is to be located at the centerline of each of the passageways 46 at the base of the shroud. The chamber volume of approximately 350 cubic inches for each of the injectors is derived from the operating analysis. The water level will be initially set at a level estimated to be approximately one to ten inches below the estimated bottom of the first tube support plate.

The injectors will be fired simultaneously at 15–22 second intervals for a period of approximately two to four hours such that the total number of slaps applied to the support plate will be 500 to 1500 cycles. After the first tube support plate is thus cleaned, the water level will be raised to a level estimated to be approximately one to ten inches below the surface of the second tube support plate and the injectors will be fired simultaneously at intervals at 15 to 22 seconds for a period of between two and four hours. The third, fourth fifth, sixth, seventh, eighth, ninth and tenth tube support plates should be similarly cleaned.

After completion of the cleaning of the uppermost tube support plate (the tenth), water will be slowly drained from the steam generator while gas injection cycles continue in order to remove debris loosened from upper tube support plates which may have become redeposited in lower tube support plate holes. Injection of gas during draindown will continue to clean the support plates and also work the sludge down to the lower tube sheet where it can be flushed and filtered as in Example 1.

The following table shows the gas pressures required at various water levels using eight injectors each discharging 0.2 cubic feet of nitrogen and resulting in a water level swell velocity of approximately five feet per second.

TABLE FOR EXAMPLE 2

| Tube Support Plate | Nitrogen Pressure | Approximate No. of Cycles | Approximate Time |
|---|---|---|---|
| 1 | 650 | 500 | 2.0 hrs. at 15 sec. |
| 2 | 775 | 500 | " |
| 3 | 1000 | 500 | " |
| 4 | 1025 | 700 | 3.0 hrs. at 15 sec. |
| 5 | 1050 | 700 | " |
| 6 | 1075 | 700 | " |
| 7 | 1100 | 500 | 2.5 hrs. at 20 sec. |
| 8 | 1100 | 500 | " |
| 9 | 1100 | 500 | " |
| 10 | 1100 | 500 | " |

EXAMPLE 3

Approximately eight nitrogen injectors similar to those described in Example 2 are installed at the bottom of a recirculating-type vessel such as vessel 150. These injectors should be located with their main gas exhaust ports just above the tube sheet. The exact number and configuration of the injectors depends on the available shell penetrations near the tube sheet 160 (additional penetrations may be necessary on some models). The chamber volume for each of the injectors is from 10 to 500 cubic inches depending upon the results of the aforementioned operating analysis steps (a)–(d), and the number of injectors to be used with the generator to be cleaned. The water level is initially set at a level estimated to be approximately one to ten inches below the estimated bottom of the first tube support structure 162, which may be a drilled plate with or without flow holes, a broach trefoil, a broach quatrefoil support plate, or an eggcrate support.

The injectors are fired simultaneously at 7–22 second intrevals for a period of approximately two to six hours. After the first tube support structure is thus cleaned, the water level is raised to a level estimated to be approximately one to ten inches below the lower surface of the second tube support structure and the injectors are fired simultaneously at 7–22 second intervals for a period of approximately 2 to 6 hours. The third, fourth, fifth, sixth, seventh, eighth, etc. tube support structures can be similarly cleaned. After completion of the cleaning of the uppermost tube support structure to be cleaned, the water is slowly drained from the steam generator while the injection of gas continues in order to remove any debris which was loosened from the upper tube support structures which may have become redeposited in lower tube support structure crevices. The injection of gas during draindown continues to clean the support structures while simultaneously working the sludge to the tube sheet where it can be removed as in Example 1.

From the foregoing it will be seen that this invention is one well adapted to obtain all the ends and objects herein set forth, together with other advantages which are obvious and which are inherent to the procedure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A water slap cleaning method for removing sludge, adherent foeign matter, and other unwanted contaminants accumulated upon internal parts within vessels comprising a plurality of vertically spaced apart generally horizontally oriented structures, said method comprising the steps of:

i. providing a working column of liquid within the interior of said vessel and initially establishing a reference liquid level below the target internal structure to be thereafter physically slapped and cleaned;

ii. periodically introducing a sequence of discrete gas injections into the bottom of the vessel at a rate and pressure controlled to eliminate sonic shock waves, each injection imparting substantial kinetic energy to said column and forcibly physically displacing said column, thereby causing the liquid column to physically accelerate upwardly until the upper surface of the liquid column forcibly and violently slaps said target internal structure, whereby said structure is cleaned by the resulting very high local flow accelerations, velocities, and pressures which break up and dislodge contaminants, adherent foreign matter, and the like;

iii. cycling said gas injections such that gas bubbles from a prior injection rise up and out of the working column of liquid and the liquid surface of said reference liquid level becomes relatively calm prior to the introduction of a subsequent injection, thereby maximizing the water slap energy associated with said method; and, iv. continuously venting said vessel to prevent gas overpressure.

2. The method as defined in claim 1 including the further step of concurrently varying the position of said reference liquid level so as to insure that water slaps will be appropriately concentrated upon the target structure being cleaned, whereby to insure that optimum water slap energy is experienced by said target structure and maximum cleaning results are achieved.

3. The method as defined in claim 1 including the further step of first cleaning the lowermost structure and thereafter pumping liquid into said column to establish a next higher reference liquid level below the level of the next target structure to be cleaned, and thereafter repeating steps ii–iv of claim 1 and thus claim until all structures have been water slapped and cleaned, thereby reducing drag loads and flow losses through and past the lower internal structure in order to maximize the velocity of impact with the upper internal structure, and to minimize stresses within submerged structures.

4. The method as defined in claim 1 wherein said vessel is an OTSG and wherein liquid swell velocity during generation of the water slap phenomena is limited to values of approximately between 2.0 feet per second and 20 feet per second to insure adequate debris loosening while avoiding damage by minimizing component stresses.

5. The method as defined in claim 4 wherein gas injections are separated by intervals of about 7 to 22 seconds, and are injected at a pressure of between approximately 25 to 1500 PSI above ambient pressure, thereby maximizing water slap efficiency.

6. The method as defined in claim 5 including the further step of first cleaning a lowermost tube support structure and thereafter pumping liquid into said OTSG to establish a next higher reference liquid level below the level of a next target tube support structure to be cleaned, and thereafter repeating steps ii–iv of claim 1 and said other steps until all tube support structures have been water slapped and cleaned, thereby reducing drag loads and flow losses through and past the lower tube support structures in order to maximize the velocity of impact with the upper tube support structures, and to minimize stresses within submerged structures.

7. The method as defined in claim 6 including the further step of continuing periodic gas injections while draining the OTSG to maintain dislodged foreign matter in suspension and thereby remove it with the drain water.

8. The method as defined in claim 7 including the further step of concurrently vigorously recirculating and filtering liquid from said shroud to externally entrain and capture dislodged foreign matter.

9. A water slap cleaning method for removing sludge, adherent foreign matter, and other unwanted contaminants accumulated upon internal parts within heat exchangers of the type comprising a plurality of cooperating heat exchange tubes for conducting a primary fluid, a casing surrounding the tubes and containing a secondary fluid, and a plurality of vertically spaced apart tube support plates for bracing said tubes, said method comprising the steps of:

i. providing a working column of liquid within the interior of said heat exchanger and initially establishing a reference liquid level below the target tube support plate to be thereafter physically slapped and cleaned;

ii. periodically introducing a sequence of discrete gas injections into the bottom of the heat exchanger at a rate and pressure controlled to eliminate sonic shock waves, each injection imparting substantial kinetic energy to said column and forcibly physically displacing said column, thereby causing the liquid column to physically accelerate upwardly until it forcibly and violently slaps said target tube support plate, whereby said tube support plate is cleaned;

iii. cycling said gas injections such that gas bubbles from a prior injection rise up and out of the working column of liquid and the liquid surface of said reference liquid level becomes relatively calm prior to the introduction of a subsequent injection, thereby maximizing the water slap energy associated with the cleaning phenomena of said method;

iv. continuously venting said heat exchanger to prevent gas overpressure; and, v. after cleaning of a target tube support plate, thereafter pumping liquid into said column to estabilsh a next higher reference liquid level below the level of the next target tube support plate to be cleaned, and thereafter repeating steps ii–iv above and this until all tube support plates have been sequentially water slapped and cleaned.

10. The method as defined in claim 9 wherein gas injections are separated by intervals of about 7 to 22 seconds, and are injected at a pressure of between approximately 25 to 1500 PSI above ambient pressure, so as to substantially eliminate sonic shock waves, and liquid swell velocity during generation of the water slap phenomena is limited to values of approximately between 2.0 feet per second and 20 feet per second to insure adequate debris loosening while avoiding heat exchanger damage by minimizing component stresses.

11. The method as defined in claim 10 including the further step of concurrently varying the position of said reference liquid level so as to insure that water slaps will be appropriately concentrated upon the target support plate being cleaned.

12. The method as defined in claim 11 including the further step of concurrently vigorously recirculating and filtering liquid within said casing to entrain loosened debris, sludge, solids and the like.

13. A water slap cleaning method for removing sludge, adherent foreign mattern, and other unwanted contaminants accumulated upon internal parts within steam generators of the type comprising a plurality of cooperating heat exchanges tubes for conducting a primary fluid, a casing surrounding the tubes and containing a secondary fluid, and a plurality of vertically spaced apart tube support plates disposed within said casing for bracing said tubes, said method comprising the steps of:

i. providing a working column of liquid within the interior of said casing and intially establishing a reference liquid level below the target tube support plate to be thereafter physically slapped and cleaned;

ii. periodically introducing a sequence of discrete gas injections into the bottom of the generator at a rate and pressure controlled to eliminate sonic shock waves, each injection imparting substantial kinetic energy to said column and forcibly physically displacing said column, thereby causing a liquid column to physically accelerate upwardly until the surface of the liquid column forcibly and violently slaps said target tube support plate, whereby said tube support plate is cleaned by the resulting very high local flow accelerations, velocities, and pressures which break up and dislodge adherent foreign matter;

wherein said gas injections are separated by intervals of about 7 to 22 seconds and are injected at a pressure of between approximately 25 to 1500 PSI above ambient pressure, so as to minimize sonic shock waves energy within said casing; and, resultant liquid swell velocity during water slap cleaning is limited to values of approximately between 2.0 feet per second and 20 feet per second to insure adequate debris loosening while avoiding generator damage by minimizing component stresses;

iii. cycling said gas injections such that gas bubbles from a prior injection rise up and out of the working column of liquid and the liquid surface of said reference liquid level becomes relatively calm prior to the introduction of a subsequent injection, thereby maximizing the water slap energy associated with the cleaning phenomena of said method; and, iv. continuously venting said generator to prevent gas overpressure.

14. The method as defined in claim 13 including the further step of first cleaning the lowermost tube support plate and thereafter pumping liquid into said column to establish a next higher reference liquid level below the level of the next target tube support plate to be cleaned, and thereafter repeating steps ii–iv above and this step until all tube support plates have been sequentially water slapped and cleaned, thereby reducing drag loads and flow losses through and past the lower tube support plates in order to maximize the velocity of impact with the upper tube support plates, and to minimize stresses within submerged structures.

15. The method as defined in claim 4 including the further step of concurrently varying the position of said reference liquid level so as to insure that water slaps will be appropriately concentrated upon the target support structure being cleaned, whereby to insure that optimum water slap energy is experienced by said target support structure and attendant maximum cleaning results are achieved.

16. A water slap cleaning method for dislodging unwanted contaminants accumulated upon internal parts within OTSG steam generators comprising a plurality of heat exchange tubes and a plurality of vertically spaced apart tube support plates, crates or structures for bracing said tubes, said method comprising the steps of:

A. Impacting the tube support plates within the OTSG by:

i. providing a working column of liquid within the interior of said OTSG and initially establishing a reference liquid level below the target tube support plate to be thereafter physically slapped and cleaned;

ii. periodically introducing a controlled sequence of discrete gas injections into the bottom of the OTSG, each injection imparting substantial kinetic energy to said column and forcibly physically displacing said column, thereby causing the column to physically accelerate upwardly until it forcibly and violently slaps said target tube support plate, whereby said tube support plate is cleaned in response to kinetic energy physically transmitted by the column;

wherein said gas injections are separated by intervals of about 7 to 22 seconds and are injected at a pressure of between approximately 25 to 1500 PSI above ambient pressure, so as to minimize sonic shock waves energy within said shroud; and, resultant liquid swell velocity during water slap cleaning is limited to values of approximately between 2.0 feet per second and 20 feet per second to insure adequate debris loosening while avoiding generator damage by minimizing component stresses;

iii. cycling said gas injections such that gas bubbles from a prior injection rise up and out of the working column of liquid and the liquid surface of said reference liquid level becomes relatively calm prior to the introduction of a subsequent injection, thereby maximinizing the water slap energy associated with the cleaning phenomena of said method;

iv. continuously venting said OTSG to prevent gas overpressure; and, v. after cleaning of a target tube support plate, thereafter pumping liquid to establish a next higher reference liquid level below the level of the next target tube support plate to be cleaned, and thereafter repeating steps ii–iv above and this step until all tube support plates have been sequentially water slapped and cleaned; and, B. thereafter draining the OTSG and continuing periodic gas injections to maintain dislodged foreign matter in suspension and thereby remove it with the drain water.

* * * * *